US007818827B2

(12) United States Patent
Chien

(10) Patent No.: US 7,818,827 B2
(45) Date of Patent: Oct. 26, 2010

(54) ILLUMINATED SHOWER HOOK

(76) Inventor: Tseng-Lu Chien, 8F, No. 29, Alley 73, Lin-Shen Road, Shi-Chi Town, Taipei Hseng (TW)

( * ) Notice: Subject to any disclaimer, the term of this patent is extended or adjusted under 35 U.S.C. 154(b) by 1094 days.

(21) Appl. No.: 11/490,060

(22) Filed: Jul. 21, 2006

(65) Prior Publication Data

US 2008/0016613 A1 Jan. 24, 2008

(51) Int. Cl.
*A47K 3/08* (2006.01)
*A47K 3/14* (2006.01)

(52) U.S. Cl. ..... 4/558

(58) Field of Classification Search ..... 4/558, 4/607–610; 16/87.2; 24/716
See application file for complete search history.

(56) References Cited

U.S. PATENT DOCUMENTS 5,412,553 A * 5/1995 Wojski ..... 362/253
5,421,059 A * 6/1995 Leffers, Jr. ..... 16/87.4 R

* cited by examiner

*Primary Examiner*—Huyen Le
(74) *Attorney, Agent, or Firm*—Bacon & Thomas, PLLC

(57) ABSTRACT

An illuminated shower hook includes a hook body, power pack, and lighting element such as a light emitting diode, electro-luminescent element, chemical phosphor element, or light-absorbing element to provide pleasing illumination for bathroom activities.

9 Claims, 5 Drawing Sheets

D1
025C
D2
D3
D4
D5
D6
D7
D8
D9
D10
D11
D14
D

E1
E2
E3
E4
E5
E6
E7
E9
E10
E11
E12
E13
EE

POLY

METAL

WOOD

CERAMIC

PLASTIC

ILLUMINATED SHOWER HOOK

BACKGROUND OF THE INVENTION

The current invention is an illuminated shower hook. The shower hook includes a light means that exhibits lighting effects through a display area being arranged to allow people to see the splendid light effects. Prior art shower hooks are described in U.S. utility and Design Pat. Nos. D515,912, D505,614, D505,315, D489,249, D479,074, 6,530,120, D464,867, D459,201, D458,536, D456,696, D439,141, D436,024, 6,038,749, 5,894,642, 5,586,375, D344,670, D295,607, D272,129, D268,005, D253,276, but none of these patents discloses an illuminated shower hook.

SUMMARY OF THE INVENTION

The preferred light means use any desired combination of one or more of a light emitting diode (LED), electro-luminescent element (EL), chemical phosphor element (CPE), and/or light absorbing phosphor element (LAP), to create appropriate lighting effects to meet market requirements and cost considerations, thereby offering people nice and elegant lighting while in the restroom.

DETAILED DESCRIPTION OF THE PREFERRED EMBODIMENTS

Figure 1:
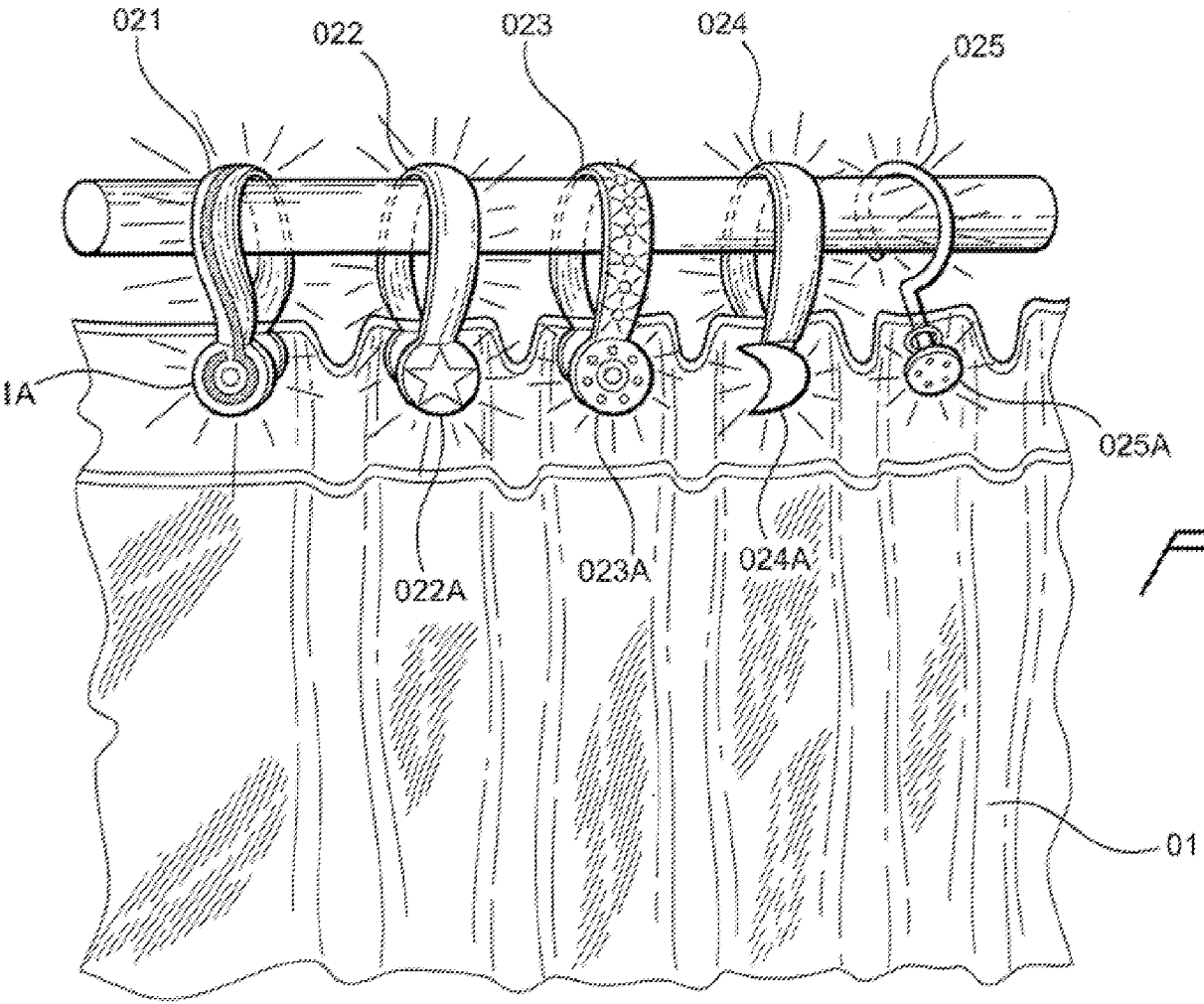
FIG. 1 is a perspective view of a shower curtain with illuminated hooks having a variety of preferred hook designs.

FIG. 1 shows a shower curtain (01) with a plurality of hooks (021) (022) (023) (024) (025) to hold the curtain's weight and enable the curtain to be extended to a desired width while people take a shower. The hooks (021) (022) (023) (024) (025) are preferably illuminated on the rod by light means which can be selected from the group consisting of at least one light emitting diode (LED), at least one electro-luminescent element (EL), at least one chemical phosphor element (CPE), at least one light absorbing phosphor element (LAP), and/or any combination of one or more LEDs, ELs, CPEs, or LAPs, having appropriate light effects to meet market requirements and cost considerations so as to offer people a nice and elegant light effect when in the restroom. The hooks can have any design and construction that meets the market requirements and/or fashion ideas.

The hook (021), for example, includes a chemical phosphor element(s) of the type used in concert light-stick applications, which provide a light output when bent to get desired color, brightness for certain hours. The chemical phosphor element(s) may be installed within a groove on the hook's body and can be replaced when the light stick no longer outputs light. The display areas may be on any location of the hook itself, such as the area (021A) in which the light stick forms a loop.

The hook (022), on the other hand, includes a light absorbing phosphor material (LAP) that absorbs ambient light beams incident on the phosphor material. When the ambient light reaches a certain brightness level, the LAP material attains a brightness that enables it to be seen by the viewer for certain hours depend on the material quality and specification. This kind of LAP material is often applied to a youth room's ceiling in star, moon, space shuttle shape(s) so that the ceiling takes on the appearance of the night sky. The current invention may have a star (022A) or any other design to meet consumer requirements.

The hook (023) has a variety of LEDs on the display areas, including different surfaced of the hook. (023). All the black dots may use chip-type LEDs fixed on a flexible circuit board to connect with a circuit (not shown), power source (not shown), and circuit means (not shown) to switch selected lights on and off and thereby exhibit predetermined light effects such as steady state, chasing, random, pair flashing, sequential, or any other effects with predetermined cycles, brightness, color, duration, time delay, and so forth according to market requirements.

The hook (024) supports EL element(s) in the form of a panel or sheet incorporated with the hook body to provide the hook with functions and/or predetermined light effects such as steady state, chasing, random, pair flashing, sequential, or any other effects with predetermined cycles, brightness, color, duration, time delay, and so forth according to market requirements.

The hook (025) supports EL element(s) in the form of an EL tube or wires such as disclosed in the Inventor's U.S. Pat. Nos. 6,082,867, 6,270,229, 6,976,762, and 6,945,663. All these EL elements in wire, tube, or loop form can incorporate rigid metal wires in their interior to keep the hook shape and have a sufficient pulling strength to safety hold the shower curtain and other items. The display area can be on the hook at its arc, or on a power pack's surface with proper circuit and control means exhibit functions or predetermined light effects such as steady state, chasing, random, pair flashing, sequential, or any other effect with predetermined cycles, brightness, color, duration, time delay and so forth according to market requirements.

Figure 2:
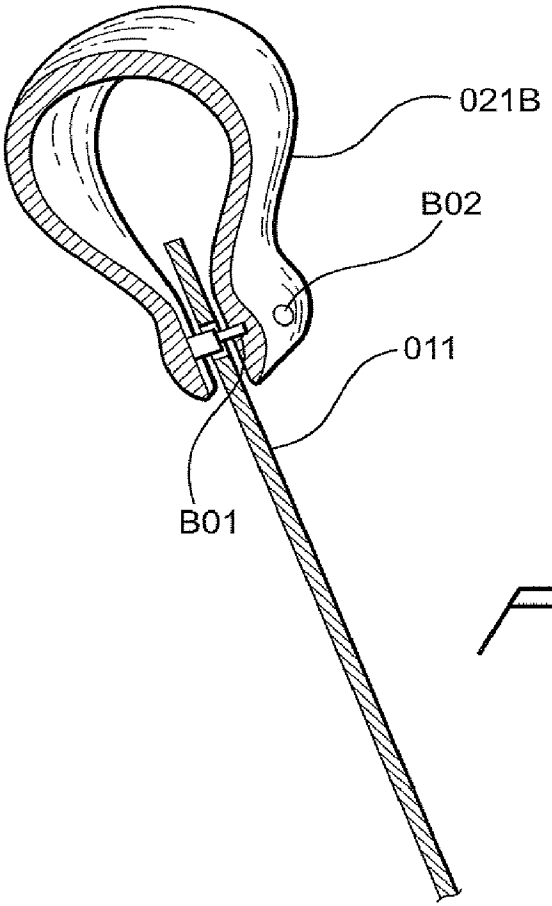
FIG. 2 is a perspective view of a shower hook according to a first preferred embodiment of the invention.

According to the first preferred hook construction shown in FIG. 2, the hook (021B) includes a pin member (B01) arranged to be press fit into the hole (B02) so as to join the left and right sides of the hook after placement over a support rod (not shown). The curtain (011) is held by pin member (B01) between the left and right sides of the hook.

Figure 3:
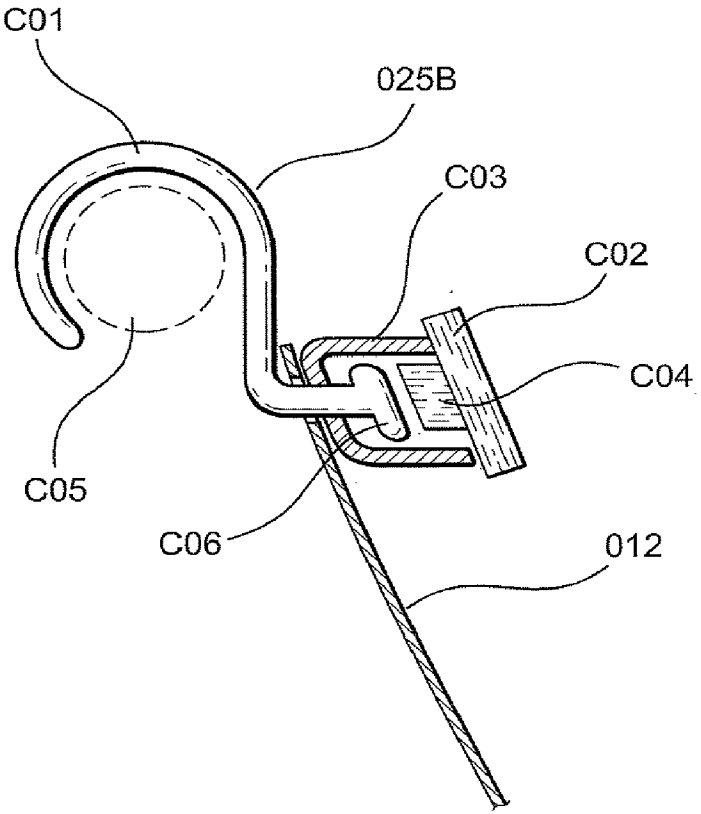
FIG. 3 is a side view of an illuminated shower curtain hook according to a second preferred embodiment of the invention.

According to the hook construction shown in FIG. 3, the hook (025B) has an arc shaped area (C01) with a base (C06). The hook (C01), display unit (C02), and power pack (C04) are fixed within the housing (C03) by attachment means which secure the display unit (C02) to the hook. The power pack (C04) includes proper circuit and control means, and a power source, to cause the display unit (C02) to exhibit predetermined light effects such as steady state, chasing, random, pair flashing, sequential, or any other effects with predetermined cycles, brightness, color, duration, time delay to meet market requirements. The hook (C01) passes though the curtain's hole (not shown) and hangs on the rod (C05).

Figures 4, 5:
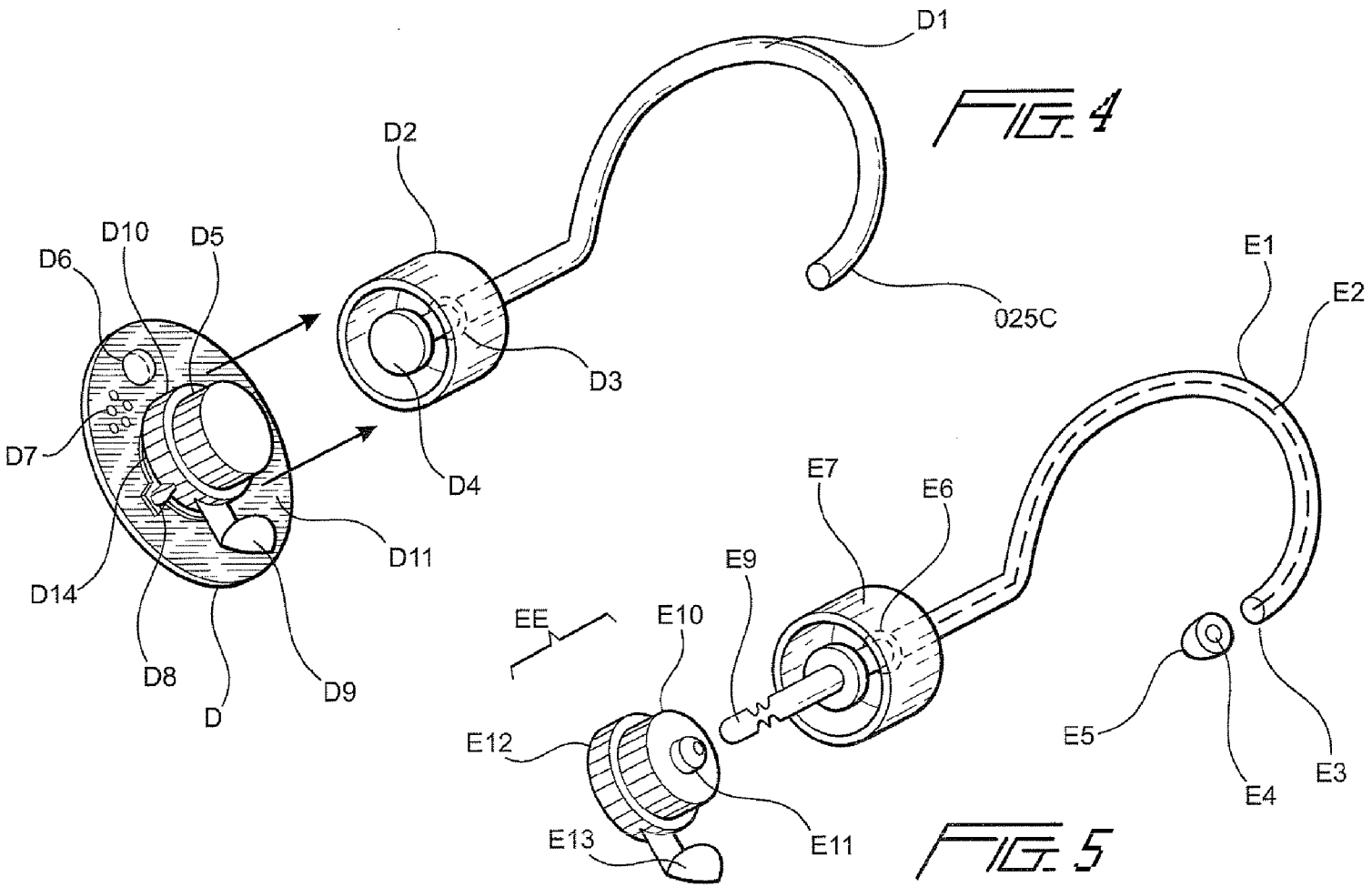
FIG. 4 is a perspective view showing further details of the illuminated shower hook of FIG. 3.
FIG. 5 is a perspective view of an illuminated shower hook according to a fourth preferred embodiment of the invention.
Figure 4A:
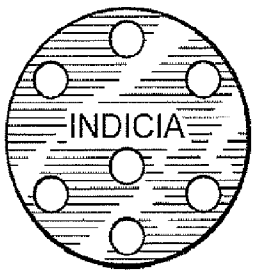
FIGS. 4A to 4F are plan views of variations of the shower hook of the first preferred embodiment.
Figure 4B:
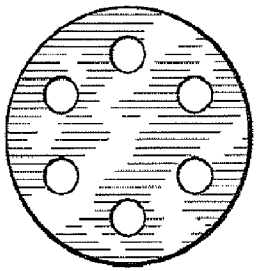
Figure 4C:
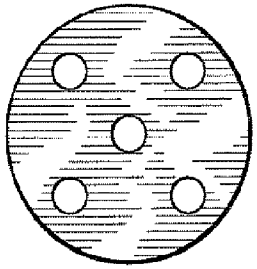
Figure 4D:
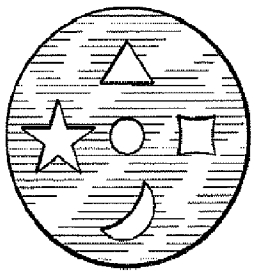
Figure 4E:
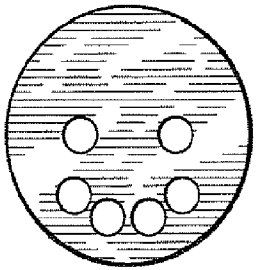
Figure 4F:
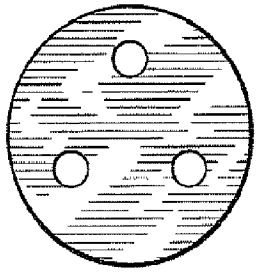

FIG. 4 shows details of the shower hook arrangement of FIG. 3. The hook arc portion (D1) has a base (D4) which passes though the housing (D2) and its hole (D3) to allow the hook (025C) to join with the display unit (D). The display unit (D) has a power pack with cover (D5) and base (D10). The base (D10) is soldered or otherwise affixed to the Display panel (D11). The display panel (D11) is a printed circuit board which has an IC Chip (D6), several connectors (D7), isolating area (D14), solder area (D8), and inner control and power source means to make up the display unit (D). The display area can be provide on the hook's arc or the power pack's surface, and includes appropriate circuitry, control means, and a power source to provide predetermined functions or light effects such as steady state, chasing, random, pair flashing, sequential, or any other functions with predetermined cycles, brightness, color, duration, time delay to meet market requirements.

FIGS. 4A, 4B, 4C, 4D, 4E, and 4F show preferred indicia and LED arrangements for different numbers, colors, and brightnesses of LEDs. These LEDs are provided with suitable sealing and/or decoration and may incorporate any art work including, by way of example, a conventional sign, photo, or picture treatment. The display may be made of any combination of materials such as resin, epoxy, paper, wood, ceramic, porcelain, metal, and may further include a printed circuit board, plastic material with sealing means such as epoxy, gel, or hot sealing, as well as overlays, masking, openings, and/or wrapping to allow the display unit (D) to have a very nice, elegant appearance and value in the market place to catch consumers' eyes.

Figure 4G:
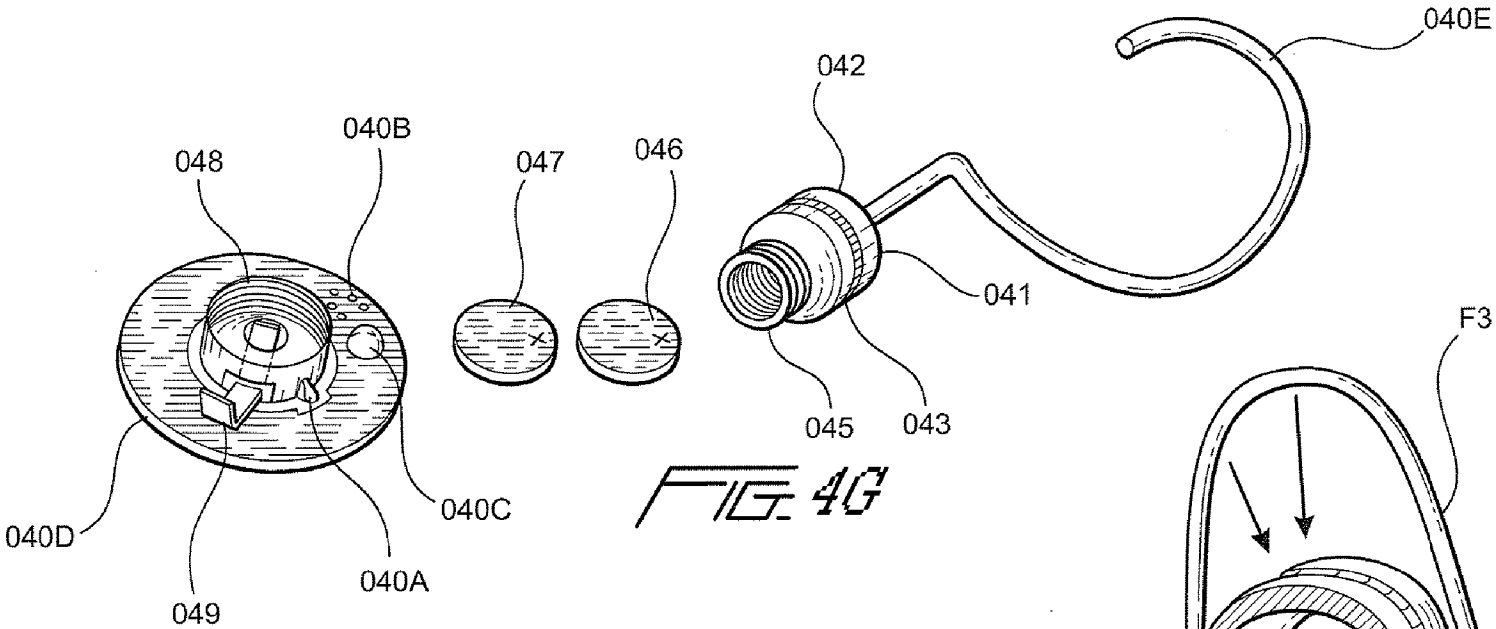
FIG. 4G is a perspective view of an illuminated shower hook according to a third preferred embodiment of the invention.

FIG. 4G shows another preferred embodiment in which an illuminated hook (040E) has a base (041) that serves as fixing means to fix the hook on the power pack cover (042), the power pack cover (042) including a screw tighten device (045) to assemble with the power pack base (048) by twisting the cover (042) onto the base (048). The base (048) is soldered to the display panel (040D) at solder point (040A). The display panel (040D) has several contactors (040B), an IC chip (040C), an isolating pull tag (049), and batteries (047) (046) so as to supply proper electric signals to the light means on the display panel (040D) for desired light effects and functions.

As shown in FIG. 5, the hook (E1) is formed by an EL element in the form of an EL wire, tube, or loop, as described in the Inventor's prior U.S. Pat. Nos. 6,082,867, 6,270,229, 6,976,762, and 6,945,663. The EL hook (E1) has an appropriate metal wire (E2) inside so the EL hook (E1) can maintain a hook shape and have a sufficient pulling capability to hold the curtain weight. In this embodiment, the EL hook (E1) has a tip (E3) sealed by a cover (E5), the EL wire extending into a hole (E4) in the cover. The other end of the EL wire extends through a hole (E6) in the housing (E7) to assemble the EL wire to the housing. The EL hook (E1) has a base to allow quick installation to a plug (E9), enabling the EL hook (E1) to be quickly connected with circuit means (EE) to supply the electric signal that causes the EL hook to exhibit desired light effects. The circuit means (EE) includes a cover (E10) and base (E12), both of which may be fastened by tightening means or catch means selected from commercially available types. An optional isolating tag (E13) may be added to the circuit means (EE) to ensure 100% electric cut-off before delivery.

The EL illumination of FIG. 5 provides the whole hook (E1) with very even brightness along its elongate shape, for a very nice lighting effect. The circuit means (EE) includes all the control means, circuit means, switch means, and power source to make the light have very attractive effects and functions.

Figure 6:
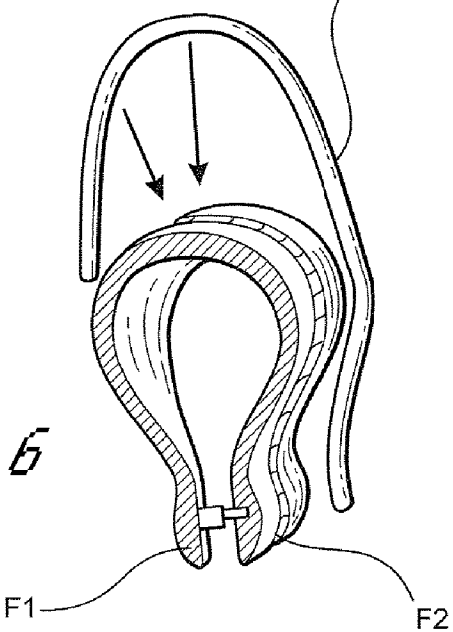
FIG. 6 is a perspective view of an illuminated shower hook according to a fifth preferred embodiment of the invention.

FIG. 6 shows an embodiment that includes a hook (F1) having a groove (F2) along its shape. A chemical phosphor element (F3) is fitted into the groove to exhibit the lighting effects described above.

Having thus described preferred embodiments of the invention in sufficient detail to enable those skilled in the art to make and use the invention, it will be appreciated that numerous variations and modifications may be made without departing from the scope of the invention. It is therefore intended that the invention not be limited to the specific embodiments described herein, but that the invention be limited solely by the appended claims.

The invention claimed is:

1. An illuminated shower hook, comprising:

a hook body arranged to support a shower curtain;

at least one light means selected from the group consisting of a light emitting diode, electro-luminescent element, chemical phosphor element, and light-absorbing phosphor element for illuminating the hook;

at least one housing arranged to install said light means, and circuit means for controlling said light means on the hook body, said hook body including a display area on an arc portion of the hook body or on a surface of the housing.

2. The illuminated shower hook as claimed in claim 1, wherein said hook is made of a material selected from the group consisting of metal, plastic, wood, porcelain, ceramic, pottery, die-casting, and rubber.

3. The illuminated shower hook as claimed in claim 1, wherein the display area is located on the hook body for desired illumination.

4. The illuminated shower book as claim 1, wherein the circuit means includes parts which are selected from any combination of a power source, a switch means, isolating means, sensor means, a vibration switch, time delay means, integrated circuit (IC) means, photo sensor means, photo diode means, or conventional market available or replaceable components to create appropriate light functions and effects.

5. The illuminated shower hook as claimed in claim 1, wherein the display area's surface includes art work made by a printing process or painting process with a desired configuration, shape, or curvature.

6. The illuminated shower hook as claimed in claim 1, wherein the hook body holds the shower curtain by passing though a curtain hole or clip.

7. The illuminated shower hook as claimed in claim 1, wherein the hook is made of metal incorporated with a plastic housing to hold the display unit, power source, and circuit means.

8. The illuminated shower hook as claimed in claim 1, further comprising a power source that includes a dry cell, solar module/generator, or plurality of batteries.

9. An illuminated shower hook, comprising:

a hook body arranged to support a shower curtain;

at least one light means selected from the group consisting of a light emitting diode, electro-luminescent element, chemical phosphor element, light-absorbing phosphor element, and combinations of any two or more of the light emitting diode, electro-luminescent element, chemical phosphor element, or light-absorbing phosphor element for illuminating the hook;

at least one housing arranged to install said light means, and circuit means for controlling said light means on the hook body, said hook body including a display area on an arc portion of the hook body or on a surface of the housing for illumination under pre-determined functions and light effects.

* * * * *